US005259079A

United States Patent [19]

Visser et al.

[11] Patent Number: 5,259,079

[45] Date of Patent: Nov. 9, 1993

[54] DOUBLE BED ARRANGEMENT WITH COMBINATION MATTRESS

[75] Inventors: Barney D. Visser, Denver; Robert L. Rensink, Arvada, both of Colo.

[73] Assignee: Big Sur Waterbeds, Inc., Denver, Colo.

[21] Appl. No.: 65,555

[22] Filed: May 20, 1993

Related U.S. Application Data

[63] Continuation-in-part of Ser. No. 29/000,767, Oct. 26, 1992.

[51] Int. Cl.[5] ..... A47C 27/10; A47C 27/18; A47C 27/05

[52] U.S. Cl. ..... 5/450; 5/451; 5/464; 5/475; 5/481; 5/901

[58] Field of Search ..... 5/451, 450, 449, 475, 5/481, 464, 455, 901, 917, 919

[56] References Cited

U.S. PATENT DOCUMENTS

| | | | |
|---|---|---|---|
| 2,651,788 | 9/1953 | Forwood | 5/464 |
| 3,274,625 | 9/1966 | Metzger | 5/464 |
| 3,732,585 | 5/1973 | Krehbiel | 5/451 |
| 3,736,604 | 6/1973 | Carson, Jr. | 5/451 |
| 4,015,299 | 4/1977 | Tinnel | 5/451 |
| 4,187,566 | 2/1980 | Peterson | 5/451 |
| 4,213,214 | 7/1980 | Gilhooly | 5/464 |
| 4,224,706 | 9/1980 | Young et al. | 5/449 |
| 4,389,743 | 6/1983 | Callaway | 5/464 |
| 4,449,261 | 5/1984 | Magnusson | 5/465 |
| 4,597,120 | 7/1986 | Fogel et al. | 5/451 |
| 4,713,852 | 12/1987 | Fox, Sr. et al. | 5/451 |
| 4,912,789 | 4/1990 | Maxwell | 5/450 |
| 5,005,238 | 4/1991 | Freet | 5/451 |
| 5,107,558 | 4/1992 | Luck | 5/464 |

*Primary Examiner*—Alexander Grosz
*Attorney, Agent, or Firm*—W. Scott Carson

[57] ABSTRACT

A double bed arrangement having a combination mattress including a liquid filled side and a non-liquid filled cushion side. A compressible foam tray holds the non-liquid cushion side in a first portion or half of the tray with the liquid-filled cushion being located in a second portion or half of the tray. Preferably, the liquid filled cushion comprises a plurality of water filled tubes. A first waterproof liner covers the foam tray and a second waterproof liner covers a bottom surface, side surface, and at least a peripheral portion of the top surface of the non-liquid filled cushion.

17 Claims, 4 Drawing Sheets

DOUBLE BED ARRANGEMENT WITH COMBINATION MATTRESS

RELATED APPLICATION

This application is a continuation-in-part of U.S. design patent application Ser. No. 29/000,767 filed on Oct. 26, 1992.

BACKGROUND OF THE INVENTION

Field of the Invention

The present invention relates to the field of bedding systems and more particularly, to the field of double bed arrangements for sleeping two adults.

Statement of the Problem

Bedding manufacturers have traditionally produced mattresses sized for two adults in industry standard bed sizes of double, queen, and king. Commonly such mattresses, no matter how large, are made of uniform construction and materials so that the entire mattress and bed provide the same degree of firmness and feel to both adults using it.

People, however, vary considerably in their desires and needs as to mattresses firmness. Often times, people who want to sleep together have very different ideas about what is a comfortable mattress. Also, people of different weights usually need different amounts of support to place their bodies in a comfortable sleeping position. Because people generally spend a significant portion of their lives in bed, it is important that the mattress provide adequate firmness to meet the needs and desires of each of the users. Unfortunately, conventional mattress designs for the most part tend to force both persons to compromise their individual desires, or at least force one of the persons to do so. Hence, it often happens that neither person is truly comfortable on a conventional mattress or to the extent one is comfortable, the other is not.

The problem is further compounded by the fact that people's mattress needs often change throughout their lives. For example, as one gets older, he or she may desire a firmer mattress to prevent back strain. Likewise, after an injury or strain to a back, one may temporarily or permanently desire a different firmness of mattress. However, the person's sleeping partner may have no such desire or need to change mattresses.

One way of solving this problem is to push two single beds together with each single bed having a separate and distinct mattress suited to each particular individual. Unfortunately, this solution often leaves an uncomfortable dip or ridge at the point where the two beds meet. Also, care must be taken that the beds are close in size and construction or they will not fit together well. For example, a conventional futon style bed will not match with a conventional inner spring mattress on a box frame. Conventional sheets, covers, and other accessories are also not commonly designed to cover single beds that have been pushed together. Thus, people who rely on using two single beds pushed together to form a double bed are greatly restricted on the size, type, style, and construction of the mattresses and accessories.

Another solution is revealed in U.S. Pat. No. 3,274,625 issued to H. W. Metzger on Sep. 27, 1966. Metzger's solution uses an inner spring mattress having a covering that includes a first quilting pattern for a first person and a second quilting pattern on the other side of the bed for a second person. The first and second quilting patterns provide different firmness. This solution provides some relief but because the pattern is sewn into the mattress, the mattress firmness cannot be changed after manufacture. Also, since the only variable is quilting pattern, only a limited degree of firmness change can be realized.

U.S. Pat. No. 2,651,788 issued to D. F. Forwood on Sep. 15, 1953 illustrates a mattress that includes first and second spring units encased in a single padded cover. The spring units can provide a different firmness to meet the desires of a particular user. The Forwood solution is adequate so long as all of the mattress users are satisfied with the comfort and firmness provided by an inner spring style mattress.

U.S. Pat. No. 5,107,558 issued to Luck on Apr. 28, 1992 shows a single size (one person) mattress having a base portion for supporting legs and feet and an insert pad designed to support the sleeper's torso. The insert supports only a portion of the sleeper and Luck teaches that the insert should be firmer than the base portion. This patent does not address the needs of a pair of sleepers sharing a mattress yet having differing firmness needs.

U.S. Pat. No. 5,005,238 issued to Freet on Apr. 9, 1991 illustrates a mattress made of foam having a plurality of holes cut in it in a row and column arrangement. The cells are filled with water bladders which can be filled to various levels to provide variable firmness from side to side as well as from head to toe of the mattress users. This solution is adequate as long as both mattress users are satisfied by the firmness provided by a foam mattress with water inserts, since the basic design is incompatible with the popular inner spring mattress design. Likewise, the Freet design is incompatible with single bladder waterbed mattresses or water bladder tube-style mattresses.

U.S. Pat. No. 4,597,120 issued to Fogel et al. on July 1, 1986 and U.S. Pat. No. 3,732,585 issued to Krehbiel on May 15, 1973 both show dual bladder waterbeds that provide mattresses with individually adjustable firmness. Water can be added or removed from each side of the mattress to change the firmness of that side without affecting firmness of the other side of the mattress. These solutions are adequate so long as both people enjoy the firmness and feel provided by a liquid filled mattress. However, these mattresses provide no solution if either person does not like a waterbed.

U.S. Pat. No. 4,449,261 issued to Magnusson on May 22, 1984 shows a two person mattress having a frame portion with a cavity. The cavity is filled with first and second inserts which can be either foam-style mattresses, inner spring-style mattresses, or an air filled mattress. The Magnusson mattress provides a wide range of firmness for each person using the two person mattress. However, all of the mattress inserts shown by Magnusson are conventional non-liquid filled mattresses so that persons enjoying waterbeds cannot be satisfied.

Taken as a whole, the above references to the state of the art illustrate and teach away from any suggestion to combine liquid filled mattresses with conventional inner spring and foam mattresses. This is believed to be due at least in part to the fact that the manufacturing technologies are so divergent; those skilled in inner spring and compressible foam mattress design are unfamiliar with the liquid dynamics and mechanical support needs of waterbed industry. Likewise, conventional mattress manufacturers use almost entirely different equipment and labor skills from that employed in liquid filled mattresses that use, for example welded vinyl construction. Importantly, there is an underlying concern that leaks in a liquid filled mattress would ruin conventional foam and inner spring mattresses and so these mattress styles are seemingly inherently incompatible.

To fully meet the needs of the sleeping public, however, a mattress design that combines liquid filled cushions with non-liquid filled cushions is needed. Moreover, a mattress that reliably combines dry mattress technology with wet or waterbed mattress technology in a manner that minimizes risk of damage to the entire mattress is needed.

SUMMARY OF THE INVENTION

The present invention involves a double bed arrangement for two adults having a combination mattress with a liquid filled side for one of the adults and a non-liquid filled cushion side for the other adult. To accomplish this, the present invention includes a tray having a raised peripheral portion that defines a central cavity. The non-liquid filled cushion is located in a first portion or half of the central cavity and the liquid filled cushion, which may comprise one or more liquid filled bladders, is located in a second portion or half of the central cavity. The combination mattress in accordance with the present invention includes a first waterproof liner covering the tray and a second waterproof liner covering the bottom surface, side surface, and an edge portion of the top surface of the conventional non-liquid filled cushion. This allows successful and reliable combination of the liquid and non-liquid filled sides into a double bed.

DETAILED DESCRIPTION OF THE PREFERRED EMBODIMENTS

A. Overview

Figure 1:
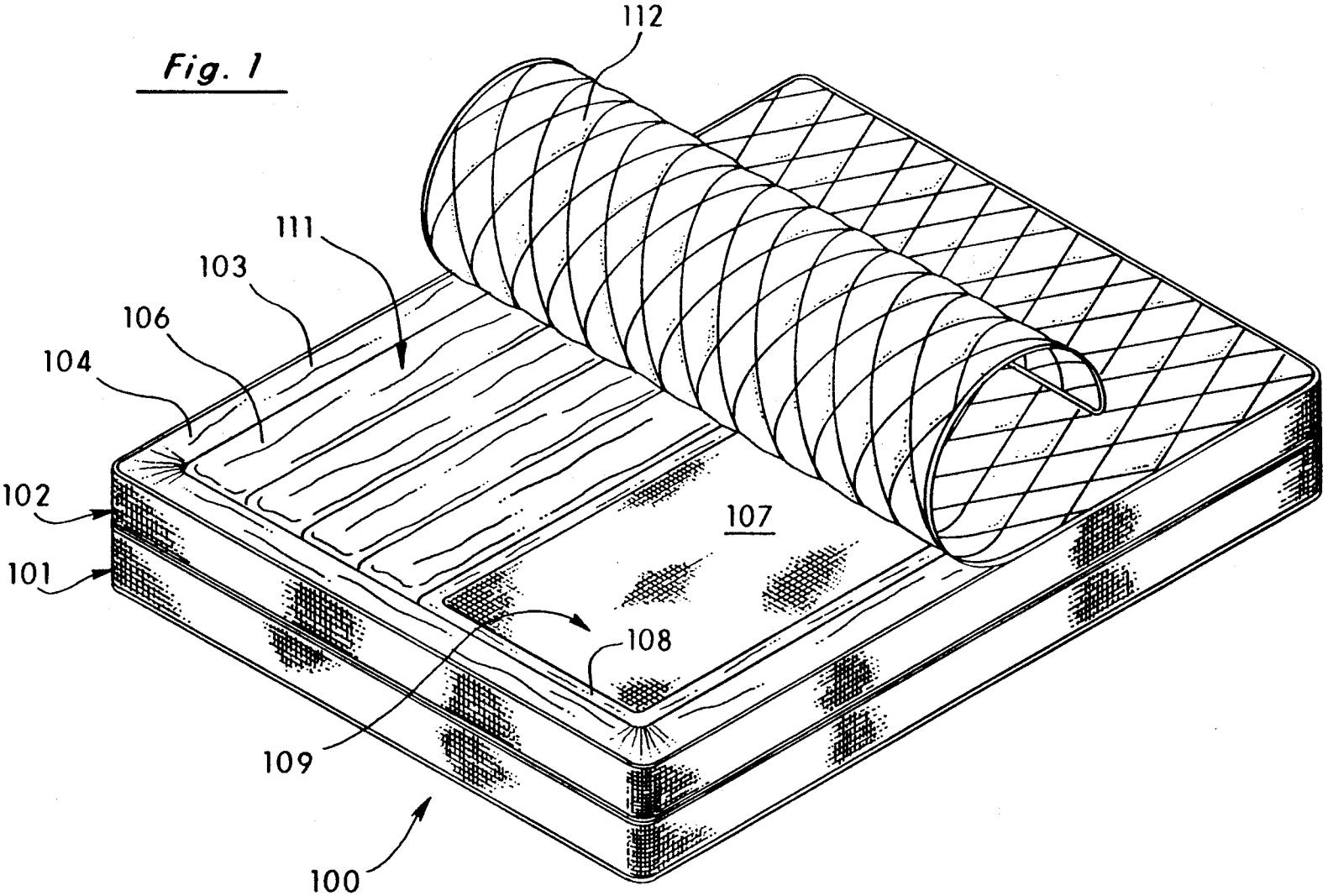
FIG. 1 is a perspective view of an assembled bed with a first embodiment of a combination mattress in accordance with the present invention.

FIG. 1 is a perspective view of an assembled double bed 100 having a support 101 on which is placed a first embodiment of a combination mattress 102 in accordance with the present invention. For clarity, the present invention will be hereafter described in terms of a "double" bed but it is understood that this is intended to cover any bed sized to support at least two adults including conventionally sized double, queen, and king size beds. Referring again to FIG. 1, the combination mattress 102 of the double bed 100 is supported on support 101 which either rests directly on the floor or can be supported on legs (not shown) to raise the bed 100 as desired. Support 101 is preferably of a rigid construction used for waterbeds instead of a box spring type support used for conventional mattresses but either type, a combination of these types, or other conventional supports can be used. For appearance purposes, the side surface of rigid support 101 is preferably covered with cloth with a conventional pattern as shown in FIG. 1.

The combination mattress 102 of the present invention rests on an upper surface of rigid support 101 and preferably is not attached to rigid support 101. In accordance with the present invention, combination mattress 102 is constructed with a tray 103 (discussed in more detail below) which is lined with a waterproof liner 104. Tray 103 preferably comprises a compressible, resilient foam such as polyurethane and in the preferred embodiments has a first portion or half that holds an inner spring cushion 107 and a second portion or half that holds a plurality of liquid filled tubes 106. The outer side surface of tray 103 is covered with cloth in FIG. 1 not only to protect tray 103 but also to provide an aesthetically appealing product.

As shown in FIG. 1, combination mattress 102 has a non-liquid side 109 and a liquid filled side 111. Tray 103 is then dimensioned to receive both sides 109 and 111 of the combination mattress 102 (see also FIG. 2 and FIG. 3). The term "non-liquid" as used herein encompasses inner spring cushions, compressible foam cushions, and other conventional cushions, or even a board or rigid box but a resilient cushion is preferred. The term "liquid filled", in turn, encompasses single and multiple liquid filled bladders, bladders with baffles, waveless water mattresses, and the like filled with water or any suitable liquid.

A second waterproof liner 108 (see FIGS. 1–3) serves as a liquid barrier to protect inner spring cushion 107 from inadvertent liquid leaks and spills. As shown, liner 108 covers the bottom, side, and at least an edge portion of the upper surface of the inner spring cushion 107. In this regard, "waterproof" as used herein means resistant to water or any liquid used in the waterbed industry. The waterproof liner 108 is described in greater detail in reference to FIG. 3 and FIG. 4.

A fabric cover, which may be a quilted pillow top 112 as shown in FIG. 1, can be fastened if desired to a peripheral portion of tray 103 in any number of manners. In the preferred embodiment, it is done by a zipper on three sides and sewing on a fourth side of tray 103. This preferred fastening means allows pillow top 112 to be rolled back to reveal and provide access to the liquid filled tubes 106 and inner spring cushion 107 without detaching pillow top 112 from tray 103. Pillow top 112 is desirably provided as a one piece unit, thus eliminating any ridge or cavity that might otherwise occur at the transition between the liquid filled tubes 106 and inner spring mattress 107.

Figure 2:
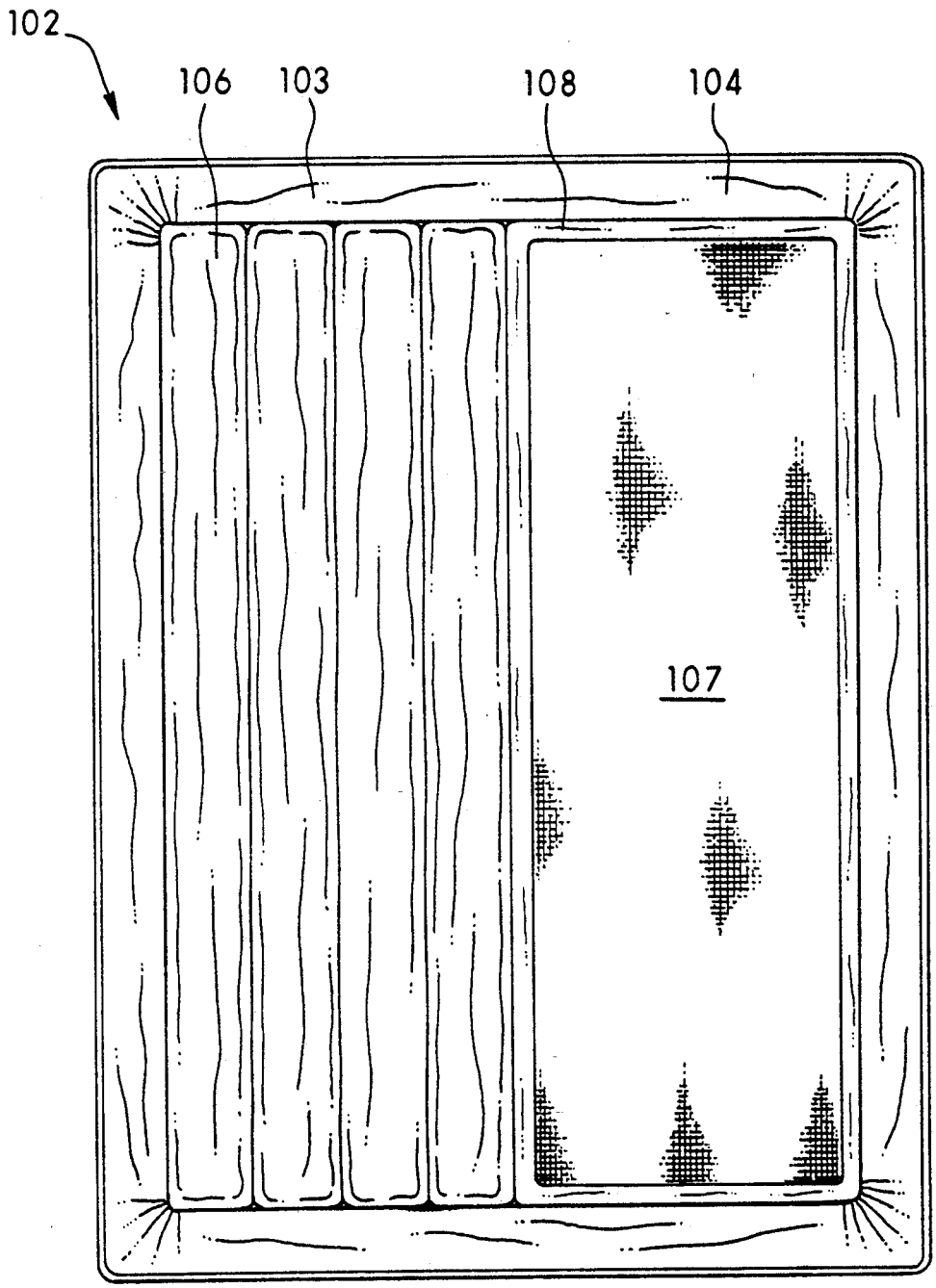
FIG. 2 is a top view of the underlying liquid and non-liquid sides of the first embodiment of the combination mattress in accordance with the present invention.

FIG. 2 is a top view of the preferred, first embodiment of the combination mattress 102 with the pillow top 112 removed for clarity. The outside dimensions of tray 103, indicated by length L and width W in FIG. 2, are chosen to match an industry standard bed size such as a double (74×52 inches), queen (80×60 inches), or king (80×76 inches) size bed. This choice, among other things, simplifies buying sheets and accessories for the user.

As stated above, tray 103 is covered by waterproof liner 104 that extends over the peripheral portion of tray 103. Further, inner spring cushion 107 is additionally fitted with the second waterproof liner 108 and positioned on one side of tray 103. Liquid filled tubes 106 then occupy the remainder of tray 103, using a side surface of inner spring cushion 107 for support. No additional barrier or extra member is needed at the interface between inner spring cushion 107 and liquid filled tubes 106 but one can be provided if desired.

In this manner, the combination mattress 102 in accordance with the present invention comprises a compressible foam tray 103 having a non-liquid, resilient cushion side 109 and a liquid filled side 111 that are positioned adjacent to each other. A wide variety of cushions can be used for either the non-liquid cushion or the liquid filled side to meet the particular needs of a user. All of the cushions are preferably removable so that the bed 100 can be initially configured and even reconfigured well after manufacture to meet the changing needs of the individual users. Two waterproof liners 104 and 108 are also provided to respectively protect tray 103 and inner spring cushion 107 from water leaks and spills.

B. Assembly and Construction Details

Figure 3:
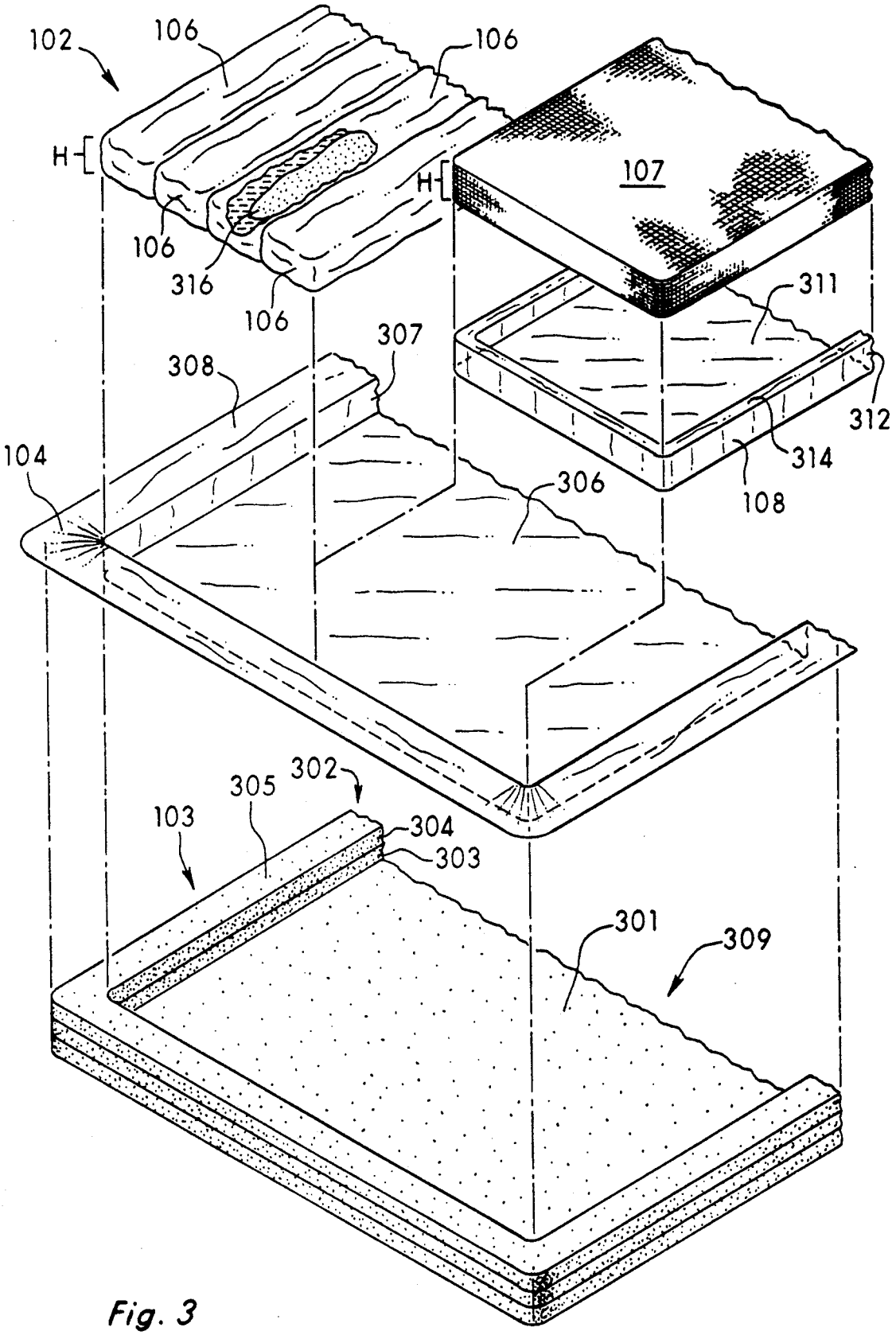
FIG. 3 is an exploded perspective view of portions of the combination mattress of FIG. 1 and FIG. 2.

FIG. 3 is an exploded perspective view of portions of combination mattress 102 illustrating the assembly and construction of combination mattress 102. Tray 103 is preferably formed from one or more pieces of compressible, resilient foam such as polyurethane foam. Tray 103 includes a bottom panel 301 and a raised peripheral portion 302. Bottom panel 301 and raised peripheral portion 302 may comprise a single type of material or may have different foam compositions. Likewise, bottom panel 301 and raised peripheral portion 302 may be formed as an integral structure from a single piece of foam that is cut to provide raised peripheral portion 302. Panel 301 and portion 302 may also be formed from multiple layers of foam such as layers 303 and 304 of raised peripheral portion 302 that are adhesively joined. These layers 303 and 304 may have different compositions, densities, and physical characteristics if desired. For example, the layer 304 may be softer than layer 303 to give the user a softer transition feel.

Raised peripheral portion 302 has a top surface 305 that serves as a transition zone when a person sits down on combination mattress 102 before lying down. The width of top surface 305 (e.g., four inches) should be selected to provide an adequate transition zone. This width should also be selected to provide sufficient thickness to raised peripheral portion 302 to support any lateral forces generated by liquid filled tubes 106 when combination mattress 102 is in use.

The upper surface of bottom panel 301 together with the peripheral portion 302 define a central cavity 309. Cavity 309 is dimensioned to receive both the liquid filled side 111 (FIG. 1) and non-liquid cushion side 109 (FIG. 1) of combination mattress 102. Additionally, at least bottom panel 301 and the inner side surface of raised peripheral portion 302 of tray 103 are covered by waterproof tray liner 104. More specifically as shown, the upper surface of bottom panel 301 is covered by bottom portion 306 of tray liner 104. The inner side surface of raised peripheral portion 302 is then covered by sidewall 307 of tray liner 104. In this manner, waterproof liner 104 provides a barrier to any liquids that may leak or spill from the liquid filled tubes 106. Waterproof liner 104 comprises a material such as vinyl. Optionally, as shown in FIG. 3, waterproof liner 104 may also extend over a portion or all of top surface 305 of tray 103 although this is not required.

A second waterproof liner 108 preferably fits over the bottom, side, and at least a portion of the top of inner spring cushion 107 to protect inner spring cushion 107 from water leaks and spills. In this regard, bottom panel 311 of liner 108 covers the bottom surface of inner spring cushion 107, side panel 312 of liner 108 protects the side surface of inner spring cushion 107, and top flaps 314 of the second waterproof liner 108 cover and protect at least a portion of the top surface of inner spring cushion 107. Waterproof liner 108 resembles a fitted sheet that is inverted and fitted onto the bottom of inner spring cushion 107 before being placed in tray 103. It is desirable that waterproof liner 108 not extend over the entire top surface of inner spring cushion 107 because such extension would alter the firmness and feel of inner spring cushion 107.

C. Non-Liquid Filled Cushion Construction Details

As indicated in FIG. 3, inner spring cushion 107 has a height H which is selected to provide a desired firmness and feel for non-liquid side 109 (FIG. 1). Additionally, the inner spring cushion 107 is preferably substantially flush or planar with liquid filled side 111 as shown in FIG. 1. Also, since it is desirable to have the overall dimensions of the bed 100 (FIG. 1) match industry standard sizes, the non-liquid filled cushion side 109 is typically undersized in length and width to allow for the raised peripheral portion 103. For example, the width of the peripheral portion 103 may be four inches wide so the non-liquid side 109 would be accordingly eight inches shorter in length than a conventional mattress (e.g., 66 inches versus 74 inches) or queen/king mattress (e.g., 72 inches versus 80 inches). Similarly, in a two person or double bed arrangement as described herein, the side 109 would be four inches narrower than any industry standard mattress if the sides 109 and 111 are to be of equal widths. Further details of liquid filled tubes 106 shown in FIG. 3 will be described hereinbelow.

Figure 4:
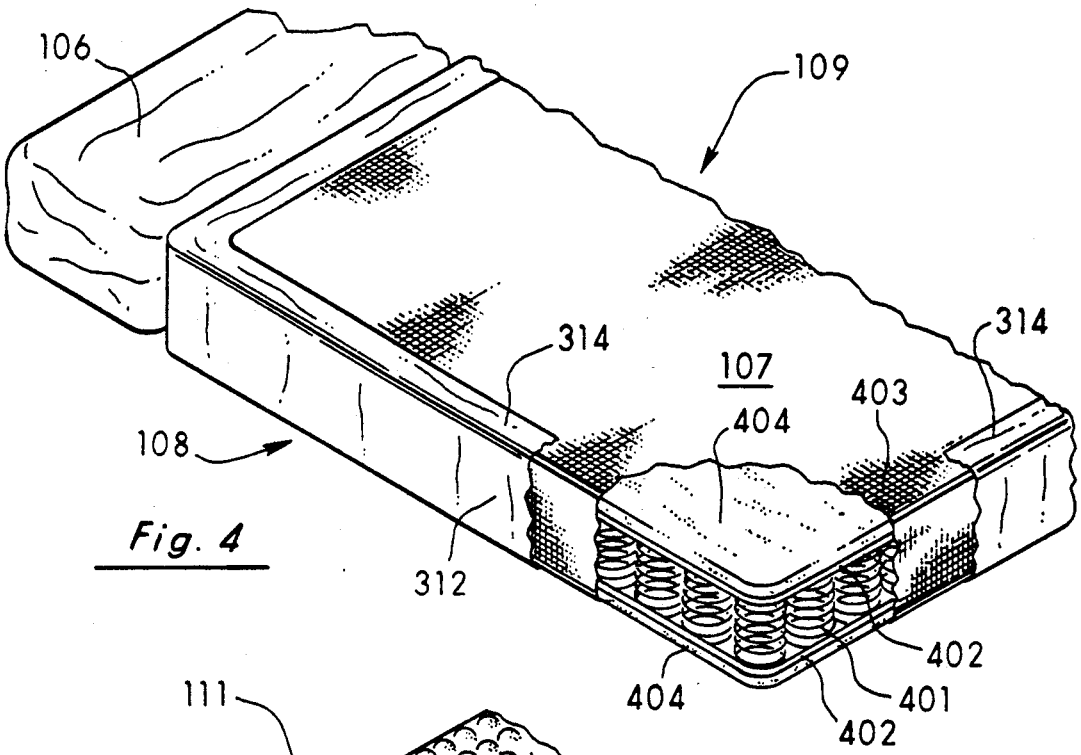
FIG. 4 shows a cut-away perspective view of portions of the combination mattress of FIG. 2 and FIG. 3.

FIG. 4 shows a cut-away perspective view of non-liquid cushion side 109 of the combination mattress 102 in accordance with the present invention. Inner spring cushion 107 is made from springs 401 that are sandwiched between metal frames 402. In the preferred embodiment, outer surfaces of frames 402 are covered with cushions 404 and the entire structure is encased in fabric cover 403. Many variations on the construction of inner spring mattress 107 are known and are equally useful in making the combination mattress 102 (FIG. 1) in accordance with the present invention. For example, springs 401 may be individually formed and encased in a fabric shell (not shown). Alternatively, springs 401 may be formed as continuous coils. Any of these well known variations may be used in conjunction with the present invention.

FIG. 4 also illustrates how liner 108 is fitted onto cushion 107 to provide a liquid barrier around the bottom, side, and a portion of the top of cushion 107. As set out above, liner 108 covers the bottom of inner spring cushion 107 and side panel 312 covers the side of inner spring cushion 107. Top flaps 314 of liner 108 in turn preferably extend over only a peripheral portion of the upper surface of inner spring cushion 107 leaving the central portion of inner spring cushion 107 uncovered to preserve the firmness and feel of inner spring cushion 107. At the same time, liner 108 protects the internal components such as springs 401, frame 402, and padding 404 from liquid leaks and spills.

D. Liquid Filled Cushion Construction Details

Construction details of liquid filled side 111 (FIG. 1) are described with reference to FIG. 3 and FIG. 5. Liquid filled tubes 106 in FIG. 3 are preferably constructed from vinyl or similar liquid proof material. In practice, the natural flow properties of liquids will flatten liquid tubes 106 so that they are substantially flush with the upper surface of inner spring mattress 107 when properly designed. Liquid filled tubes 106 then have a resulting height H that is designed in use to match that of inner spring cushion 107. Optionally, convoluted foam pieces 316 (see FIG. 3) can be placed inside some or all of liquid tubes 106 to dampen wave motion therein. Convoluted foam pieces 316 can be of a variety of shapes and their construction and use are well known in the waterbed industry.

Figure 5:
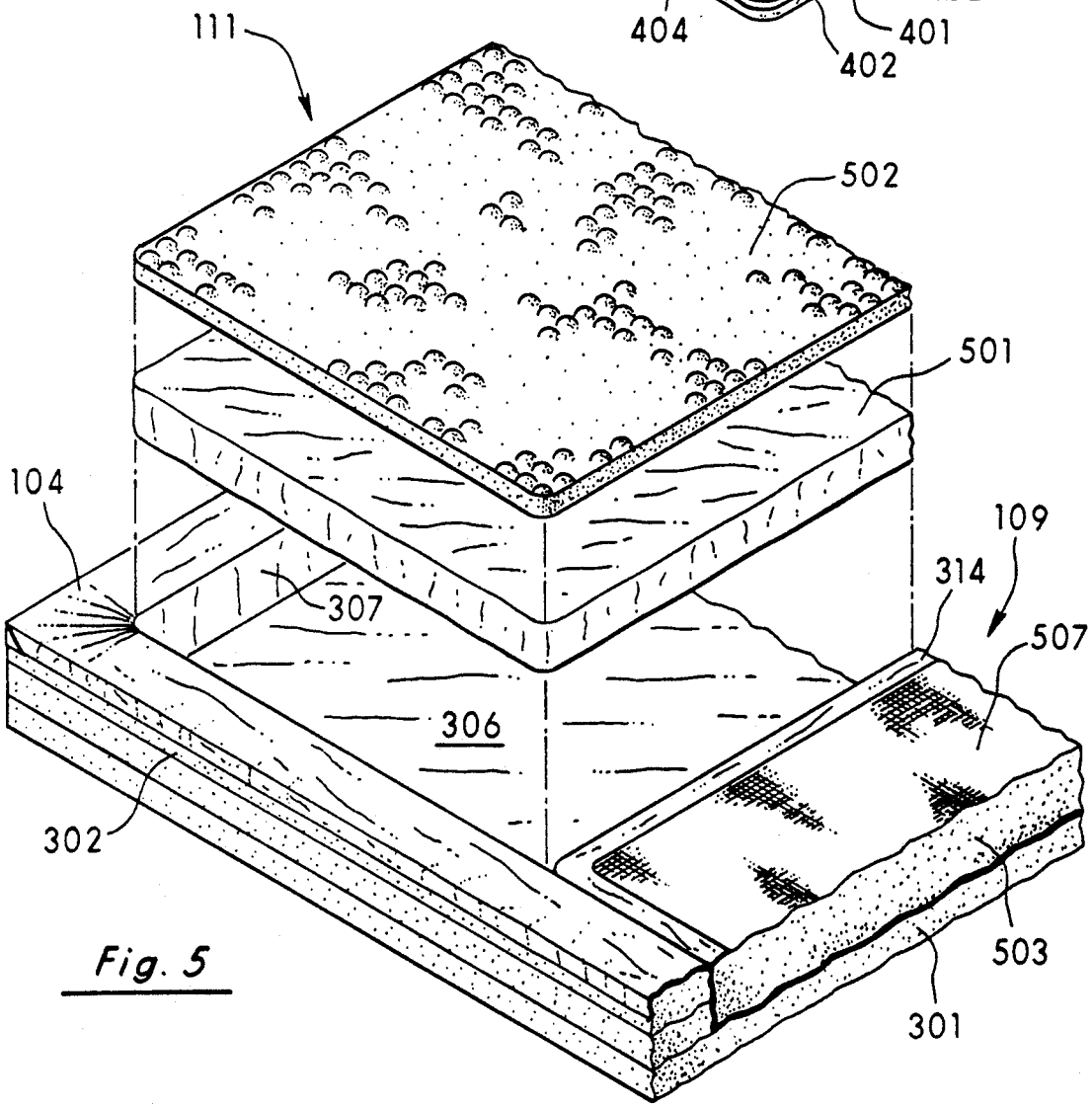
FIG. 5 illustrates a cut-away perspective view of portions of a second embodiment of a combination mattress in accordance with the present invention.

FIG. 5 illustrates a cut-away perspective view of portions of a second embodiment of a combination mattress 102 (FIG. 1) in accordance with the present invention. The second embodiment differs from the embodiment shown in FIG. 3 in that non-liquid cushion side 109 holds a resilient foam cushion 507 having a compressible foam filling 503 rather than an inner spring mattress 107 (FIG. 1–FIG. 4). The second embodiment also includes a single liquid filled bladder 501 in place of liquid tubes 106 (FIG. 1–FIG. 4) used in the first embodiment. An additional feature applicable to both embodiments and as best seen in FIG. 5 includes sizing the first waterproof liner 104 so that the edge of the liner 104 can be tucked over the raised peripheral portion at 302.

As seen in FIG. 5, a side surface of cushion 507 desirably forms a supporting member for liquid filled bladder 501. This feature of the present invention is preferably present in the first embodiment shown in FIG. 1 through FIG. 4. Liquid filled bladder 501 is similar in construction and materials to conventional single bladder water mattresses used in waterbeds. More particularly, liquid filled bladder 501 can be fabricated from one or more layers of vinyl that are glued or welded together to form a closed bag. Liquid filled bladder 501 is usually filled with water but other liquids are possible. Also, liquid filled bladder 501 may have baffles formed inside to control wave motion or may have one or more convoluted foam inserts similar to insert 316 shown in FIG. 3.

Another feature of the present invention is optional sculptured foam pad 502 which is positioned either on top of liquid filled bladder 501 as shown in FIG. 5 or on top of liquid filled tubes 106 (FIG. 1 and FIG. 3). Sculptured foam pad 502 alters the firmness and feel of liquid filled side 111 of combination mattress 102 (FIG. 1). Pad 502 may also require that the overall height or depth of the cavity be increased (e.g., from three inches to six inches). This, in turn, enables a thicker cushion to be used in the non-liquid cushion side 109. Sculptured foam pad 502 has a pattern of bumps and dents formed on at least one side to provide additional user comfort. Sculptured foam pad 502 can comprise any kind and density of plastic foam used in the bedding industry to meet specific user needs.

The double bed arrangement according to the teachings of the present invention provides great flexibility in bed design before and well after manufacture of the bed. The arrangement also allows a person who enjoys a waterbed to share a mattress with another person who enjoys conventional non-fluid filled cushions. It is to be expressly understood that the claimed invention is not to be limited to the description of the preferred embodiments but encompasses other modifications and alterations within the scope and spirit of the inventive concept. For example, the liquid filled side of the combination mattress might be filled with water, gels, or other viscous fluids of varying mixtures and compositions. Also, the non-liquid cushion side may comprise any non-liquid cushion such as a loose filled futon, combinations of foam and inner spring, or other types of cushions and pads known in the bedding industry. Accordingly, these and other like modifications of the described bed combination are within the spirit and claims of the present invention.

We claim:

1. A double bed arrangement for two adults having a combination mattress (102) with a liquid filled side (111) for one of the adults and a non-liquid cushion side (109) for the other adult, the double bed arrangement including:

a tray (103) having a bottom panel (301) with an upper surface and having a raised peripheral portion (302), said raised peripheral portion (302) having an inner side surface extending substantially about and upwardly from the upper surface of said bottom panel (301) to form therewith a depressed cavity (309), said raised peripheral portion (302) further having a substantially horizontally extending top surface (305) extending about said cavity (309) outwardly of said inner side surface of said raised peripheral portion (302), a first waterproof liner (104) having a portion (306) covering the bottom panel (301), a portion (307) covering the upwardly extending inner side surface of said raised peripheral portion (302), and a portion (308) covering at least a part of the horizontally extending top surface of the raised peripheral portion (302), said depressed cavity (309) being dimensioned to receive both sides (109 and 111) of the combination mattress (102) with the one adult lying on the liquid filled side (111) and the other adult lying on the non-liquid cushion side (109), the cavity having a width and a length with the liquid filled side (111) extending substantially the entire length of the cavity and about half of the width thereof and the non-liquid cushion side (109) extending substantially the entire length of the cavity (309) and about half of the width thereof, said liquid filled side (111) including a plurality of tube-shaped bladders (106) filled with water, said non-liquid cushion side (109) including a resilient cushion having a top surface, bottom surface, and a side surface extending therebetween, said top surface of said resilient cushion having a central portion and a peripheral portion extending thereabout immediately adjacent to the side surface of said resilient cushion, and a second waterproof liner (108) having a portion (311) covering the bottom surface of said resilient cushion, a portion (312) covering the side surface of said resilient cushion, and a portion (314) covering essentially only said peripheral portion of said top surface of said resilient cushion leaving the central portion of said top surface of said resilient cushion substantially uncovered by said second waterproof liner (108).

2. The double bed arrangement of claim 1 wherein the portion (308) of said first waterproof liner (104) completely covers the horizontally extending top surface of the raised peripheral portion (302).

3. The double bed arrangement of claim 1 wherein said resilient cushion is an inner-spring cushion.

4. The double bed arrangement of claim 1 wherein said resilient cushion is a foam cushion.

5. The double bed arrangement of claim 1 wherein the tube-shaped bladders extend substantially the entire length of the cavity.

6. The double bed arrangement of claim 1 wherein at least one of the tube-shaped bladders includes a foam means inside for reducing waves.

7. The double bed arrangement of claim 1 wherein the tray is made of foam.

8. The double bed arrangement of claim 1 further comprising a pillow top and means to fasten the pillow top over the raised peripheral portion of the foam tray.

9. The double bed arrangement of claim 8 further comprising a sculptured compressible foam pad positioned on top of the plurality of water filled bladders and underneath the pillow top.

10. The double bed arrangement of claim 1 further comprising a sculptured compressible foam pad positioned on top of the plurality of water filled bladders.

11. The double bed arrangement of claim 1 wherein the raised peripheral portion of the tray has lower and upper portions, said lower portion being adjacent to and extending above the bottom panel and said upper portion being adhesively mounted to the lower portion, and wherein the upper portion is softer than the lower portion.

12. The double bed arrangement of claim 1 further comprising a pillow top and means for positioning the pillow top over both the liquid filled side and non-liquid cushion side of the combination mattress and the raised peripheral portion of the tray.

13. The double bed arrangement of claim 1 wherein said cavity has a length of about 66 inches.

14. The double bed arrangement of claim 1 wherein said cavity has a length of about 72 inches.

15. The double bed arrangement of claim 1 wherein said resilient cushion has a height substantially equal to the height of the upwardly extending inner side surface of the raised peripheral portion (302).

16. The double bed arrangement of claim 1 wherein said tube-shaped bladders substantially fill the liquid filled side of the combination mattress using a portion of the side surface of the lined resilient cushion for support.

17. The double bed arrangement of claim 1 wherein said first waterproof liner (104) has an edge tucked over said raised peripheral portion (302).

* * * * *